United States Patent [19]

Flick

[11] Patent Number: 4,850,608

[45] Date of Patent: Jul. 25, 1989

[54] SKI BINDING DEVICE

[76] Inventor: Arnold L. Flick, 5417 Pacifica Dr., La Jolla, Calif. 92037

[21] Appl. No.: 184,208

[22] Filed: Apr. 21, 1988

Related U.S. Application Data

[63] Continuation-in-part of Ser. No. 6,965, Jan. 27, 1987, abandoned.

[51] Int. Cl.[4] ..... A63C 9/00

[52] U.S. Cl. ..... 280/625; 280/613; 280/627; 280/631; 280/634

[58] Field of Search ..... 280/613, 618, 623, 624, 280/625, 626, 627, 628, 634, 631

[56] References Cited

U.S. PATENT DOCUMENTS

| | | | |
|---|---|---|---|
| 3,606,368 | 9/1971 | Smolka et al. | 280/613 |
| 3,630,538 | 12/1971 | Klein et al. | 280/623 |
| 3,947,053 | 3/1976 | Sittmann | 280/623 |
| 4,023,824 | 5/1977 | von Besser | 280/623 X |
| 4,261,595 | 4/1981 | Smialowski et al. | 280/631 X |
| 4,703,946 | 11/1987 | Nava | 280/627 |

FOREIGN PATENT DOCUMENTS

| | | | |
|---|---|---|---|
| 895334 | 1/1945 | France | 280/623 |
| 2561114 | 9/1985 | France | 280/613 |
| 574838 | 4/1976 | Switzerland | 280/613 |

*Primary Examiner*—Charles A. Marmor
*Assistant Examiner*—Tamara L. Finlay
*Attorney, Agent, or Firm*—Charmasson & Holz

[57] ABSTRACT

A ski binding mechanism for retaining a ski boot in fixed position on a ski and providing for release of the binding at any angle and for precisely controlling the required forces at various release angles. A plurality of retaining points each consisting of a spring plunger mechanism with a spherical tip which is fitted to a contoured retaining socket or groove in the boot sole plate, and the socket or groove is milled away at its periphery are varying angles. In one embodiment, a plunger is mounted on a rocker arm to counter balance ski brake forces and to facilitate removal by altering release force levels.

14 Claims, 4 Drawing Sheets

SKI BINDING DEVICE

PRIOR APPLICATION

This is a continuation-in-part of application Ser. No. 07/006,965 filed 7-27-87 which is now abandoned.

BACKGROUND OF THE INVENTION

The objectives of maximizing snow skier safety must be balanced with the requirements of keeping the skier attached to his or her skis in varying conditions. These objectives have received a great deal of engineering and commercial attention in the past thirty years but increasing the safety of he skier remains an objective.

Failure of the skier to release during falls may result in bone fractures, particularly to the legs, while unexpected release during controlled skiing can be equally injurious. A system to safely release the skier must not only reliably release at specified forces and directions, but must also, to be commercially practical, be adjustable to account for skier ability, equipment variations and environment. Further, the system must be durable and reliably operable over a wide range of temperature and moisture conditions.

Skiers can experience different types of leg injury causing falls during skiing. One type is rapid deceleration when skis strike an object directly ahead of the skier. The object could be quite small, allowing the skier to easily travel over it, if released from the immobilized skis. Unless the boot is cushioned and immediately released allowing the heel to rotate upward as well as releasing the toe, major leg injury can result in an otherwise non-injury accident. A second type is a lateral twisting which can occur when the long edge of a ski catches, that is, fails to track during turns. Unless the boot is cushioned and immediately released allowing the toe and heel to rotate in the plane of the ground surface, serious leg injury can result in an otherwise non-injury accident. In divergent and other types of falls, the skis may get caught in deep snow or other obstructions where a ski is not parallel to the ground surface. The skier may also fall in different directions during turns or other maneuvers. Release of the ski boot must allow rotation and release in planes other than the parallel and perpendicular to the ground surface in order to avoid leg injury. At the same time, ski bindings must also not prematurely release the skis during controlled, but severe, maneuvers which exert different forces, but in similar directions to those where immediate release is required.

Existing products have tended towards greater complexity in order to particularly address the issues of specific release angles and adjustability. An example of this complexity is a patent from Switzerland, No. 574,838 by Besson which requires a sole plate, sole plate attachment to ski boots, two contoured face plates, a face plate mounting block, plungers, and related adjusting mechanisms and ski attachment hardware in order to obtain the direction specific force release features. In another example, U.S. Pat. No. 3,781,028 by Gertsch et al. and U.S. Pat. No. 3,902,729 by Druss are examples of multiple plungers/release points to obtain different release forces in different directions. As the engineering ability to address this wider range of conditions has increased the complexity and number of moving parts, a potential for decreased reliability is presented because of the opportunity for water/ice intrusion into these mechanisms, changing the operating characteristics or even preventing operation entirely.

Another approach has been to compromise safety to gain other advantages. For example, in order to permit step-in access to the binding, the heel attachment of commercial bindings has tended to be less adaptable (the design more compromised)) to the required range and directions of release angles and more attention has been given to the range of release angles of the toepiece. The result is that such bindings may not release in response to a rotational force emanating from heel towards the toe. Similarly, some bindings have not released in straight forward falls and angled upward falls because the release directions of the binding have not been continuous, but oriented in specific directions by the constraints of the moving parts of the system. For instance, almost all bindings are designed to easily release (in a horizontal plane 90 degrees from the vertical) by such mechanisms as horizontally swiveling toepieces, but those bindings will not as easily or reliably release at a release force angle of say 75 degrees unless a separate rotational mechanism is incorporated in the toepiece to move through that angle. In other words, few bindings have yet been made that can operate over the entire continuous 180 degree range of release angles both from toe and heel restraining points, and none that enable continuous or periodic adjustment of the release forces throughout the range.

Thus it is an objective of the within invention to provide a ski binding system that can be configured to release at any predetermined unidirectional force or release angle over a continuous range of forces and angles.

A further objective of the within invention is to provide a ski binding system that will release in response to rotational forces that do not trigger a release within existing systems.

Another objective of the within invention is to accommodate to the continuous range of release specifications while reliably retaining the skier in the binding in all conditions except during falls.

Further objective of the within invention is to provide a greatly simplified ski binding system with a minimum of moving parts in order that reliability and watertight integrity can be maximized.

Another objective of the within invention is to provide a ski binding system that can be easily adjusted or modified to accommodate the specific release requirements of individual skiers of all abilities.

Another objective of the within invention is to provide a ski binding system that can withstand and absorb normal shocks and transient loadings without release and also cushion the transmission of these loadings to the skier.

Finally, it is an objective of the within invention to provide a system that will not be limited to discrete or separated operating angles of release, but provide continuous release capability over the entire range of angles and forces which a ski binding system addresses.

The within invention claims particularly a plunger and socket or receiving groove attachment mechanism with a precisely machined socket or groove contoured to enable release of the plunger mechanism at specified forces and angles. The closest reference in the art known to the applicant is Gertsch U.S. Pat. No. 3,781,028, Safety Ski Binding. Gertsch is limited however, in several ways that the within device is not; specifically Gertsch uses a socket providing for equal release forces at all angles of incidence between retaining pin and boot. Further this device specifies a separate metal plate to hold the socket which plate then must be externally attached to the boot, and a four-point locking pin system is specified or two points on either end of the boot. By contrast the within invention uses either a socket or groove selectively shaped and contoured in a non-uniform fashion so as to provide unequal release forces at different angles of incidence of pin to boot, and provides that the socket or groove may be integral with the boot sole, a preferred configuration as it decreases by 1 degree the freedom of motion between the skier and the ski. Also the within invention can be configured to operate with any number of retaining pins that might be desired to tailor the response to release forces although a 3 point fixation system is considered to be the preferred embodiment because fewer may permit unstable roll moments while more may inhibit free boot movement out of the binding during forward twisting falls. Other similarly limited systems in the art include Ramillon U.S. Pat. No. 3,936,065 and Salmon, on U.S. Pat. No. 4,003,587, both of which require more moving parts and are limited in responsiveness and adjustability. Further, the use of the groove permits shock absorption action of the boot on the binding which the socket mode does not permit. This shock absorption action cushions and prevents injury to the skier, as well as allows bindings to absorb normal loadings without release.

Besson (Switzerland Patent No. 574,838) shows a ski binding system which allows specific release forces in several different directions, however, combinations of forces or forces out of the specific directions provided for are not addressed. More importantly, a disadvantangeous mechanical complexity of multiple components is required. Further disadvantages from this complexity and multiplicity occur from a doubling of releasable attachment equipment (a first attachment of ski boot to boot plate and a second attachment of boot plate to ski occurs). Additionally, the location of the contoured plates does not allow variations in skier heel to toe loadings. Moreover, this plate forces a fixed relationship between release forces at the heel and toe. Finally, the ability to walk on the boot plate is limited.

SUMMARY OF THE INVENTION

These and other objectives are achieved by providing a simple mechanism consisting of a spring-loaded plunger with a spherical tip at both the heel and toe retaining points in the ski binding each of which engages a socket or groove in the boot sole or in an external boot sole plate, and the sockets or groove are variably contoured to enable release in specific directions but more forcible restraint in other directions. The plungers are the only moving parts, and they only move in one direction and over a small range and are easily sealed to provide watertight integrity with a simple 0-ring or can be machined to quite close tolerances that will in itself prevent entry of moisture. Since the contouring of the socket or groove perimeter can be of any continuous or discrete shape or angle, the variability of the release contours are completely continuous and not limited to any discrete steps. Since there is only one adjustment for the plunger positioning and tensioning, complex fitting and positioning procedures of some of the more complex bindings are not necessary.

DESCRIPTION OF THE PREFERRED EMBODIMENT OF THE INVENTION

Figure 1:
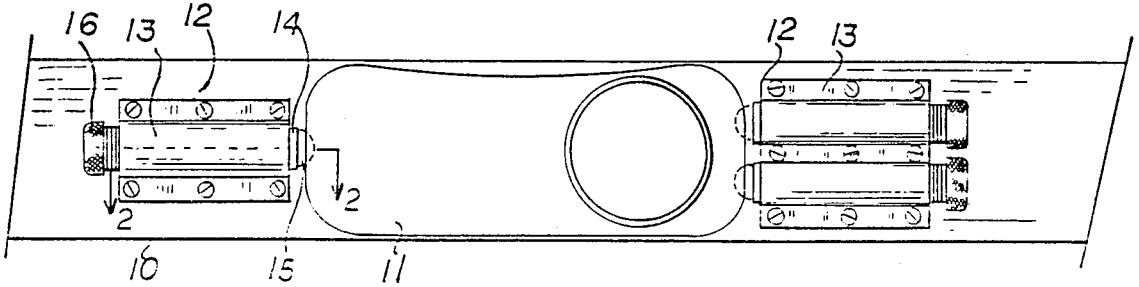
FIG. 1 shows a plan view of the ski binding mechanism showing a ski boot sole plate in representational form retained on a ski.

Referring to the drawings, FIG. 1 illustrates the basic elements of the applicant's ski binding system in plan view of a portion of the ski 10 and the boot sole plate 11 in position on the ski and retained by the ski binding mechanism. The boot sole plate is depicted in the drawing in representational form and can either be an integral part of the boot itself or an attachable sole plate for specific use with this system, the integrated embodiment being the preferred form. The boot sole plate 11 or ski boot has an essentially normal bottom surface to allow: (1) the skier to walk without removal, and (2) sliding movement, under severe loads, between the plate or boot and ski. The toe and heel retaining mechanisms depicted are essentially identical and each consists of a mounting plate 12, a generally cylindrical housing 13 containing a plunger mechanism 14 with a spherical tip 15. At the end of the housing opposite the tip is an adjusting screw mechanism 16. The boot sole plate is simply retained in the binding by the longitudinal engagement of the plunger tips at the sole and heel points. The forward portion of the tip shown as a dashed line engaged within the socket cups provided in the sole plate is described in more detail below. Contact is shown as one point at the toe and two points at the heel. Other combinations might, of course, be possible such as two or four point retaining system depending upon the anticipated needs of a particular class of skier or on the use of a plunger and socket retaining system at the toe point in a different retaining system at the heel or vice versa.

Although the representational form of FIG. 1 does not depict a typical release mechanism for voluntary exit and entry to the ski binding, it has not been shown for clarity since these items are not new. Almost any existing method of voluntary release incorporated in commercial bindings could easily be incorporated into this system, including a wedge or lever device to release the retaining spring plunger tension. For instance, the plunger adjustment knob 16 on FIG. 1 could be fitted with a number of depressions around the perimeter for receiving the tip of a typical skier's pole and when the skier pushes on the pole engaged with the plunger knob the biasing tension on the boot would be released and the skier can step out.

Figure 2:
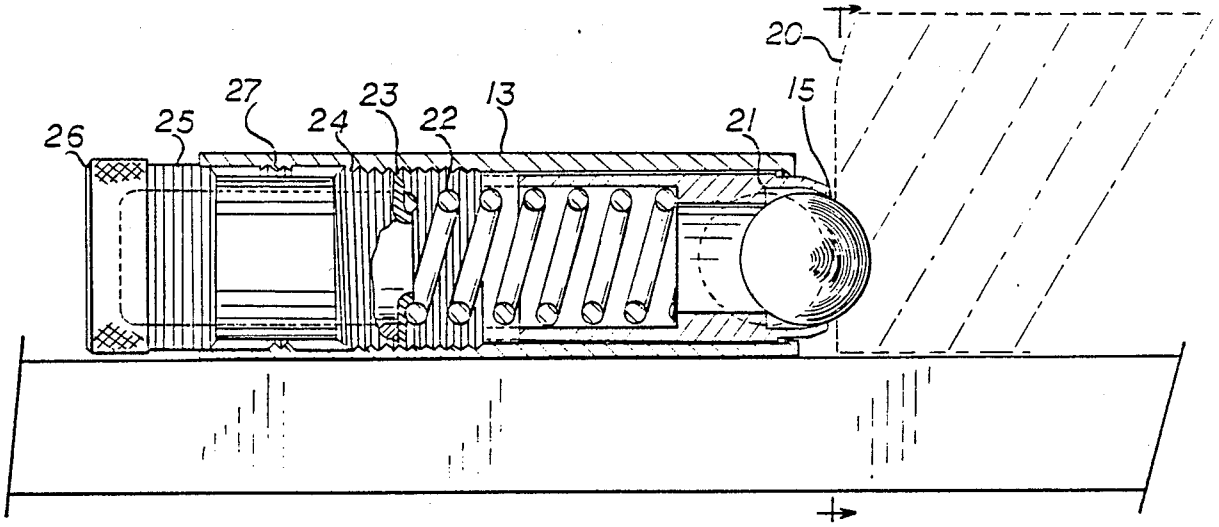
FIG. 2 is a cross-section of the toe binding plunger mechanism along line 2—2 of FIG. 1.

FIG. 2 depicts in more detail the operation of the plunger mechanism in cross-section. The engaged edge 20 of the boot sole plate is shown in phantom line and the spherical plunger tip 15 can be clearly seen here to consist of a ball-bearing seated in the forward portion of the plunger cylinder 21 in the incorporated bearing retainer and seated against a ledge or groove in engaged edge 20 of the boot sole plate. The plunger cylinder 21 and ball bearing 15 assembly could be equivalently replaced with a solid plunger provided the plunger tip is generally hemi-spherical. The plunger cylinder is biased to the extended position by spring 22 and the spring is in turn positioned and retained by spring-keeper 23 in the shape of a spring seat and thrust plate. Threaded tension screw 24 can be adjustably positioned within the cylindrical housing to move the spring-keeper plate fore or aft to adjust the load-spring tension and thus the retaining force exerted by the plunger. Index lines 25 at the tension screw portion extending past the exit end of the cylindrical housing provide a means of measuring and indicating the applied spring tension and the tension screw is terminated by a knurled head 26. Also illustrated in the view is a short length of safety thread 27 which would prevent the tension screw form falling out of the housing entirely even if it were to back out of adjusting threads, and would require two more turns before the screw were removed as for maintenance. This view illustrates that there is an absolute minimum of moving parts or opportunities for moisture to enter the system.

Figure 3:
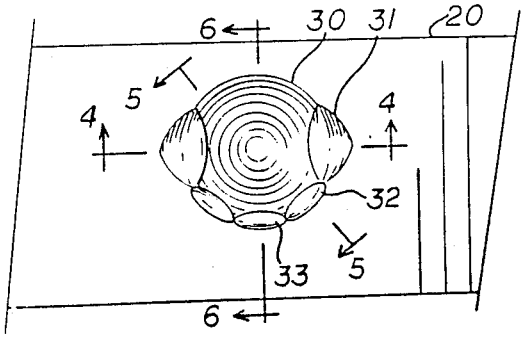
FIG. 3 is a elevation view of a retaining socket in the boot.

FIG. 3 illustrates a configuration of the mating socket on the boot sole plate which receives the plunger. A concave hemisphere 30 forms a retaining socket cavity of the same radius as the ball-bearing plunger tip and the rim of the socket thus formed is milled away at angles relative to the axis of the plunger, forming cavities or ledges corresponding to desired release force and direction form the binding assembly. For instance at the lateral directions along line 4—4, a large indentation 31 has been milled away which would enable the ball-bearing plunger tip to move more easily in either of those directions. Similarly a smaller depression 32 has been milled 45 degrees to the right along line 5—5 which would enable the ball-bearing to move more freely in that direction than the opposite direction in which it is fully restrained by the rim of the socket, but since less material has been removed the restraining force would be more than required along the larger depression at the horizontal. Similarly depression 33 is milled at the lower vertical point along line 6—6 which would enable the plunger tip to move down not up along that line.

As illustrated in FIG. 3, the socket 30 is placed in the boot sole plate and when subject to a sufficient releasing force the socket and the sole plate would be released while the plunger remains stationary on the ski. Therefore, the arrangement of the depressions 31, 32, and 33 will provide for varying releasing forces in left and right horizontal directions left and right 45 degrees upward movement and in 90 degree upward movement of the sole plate and socket. The arrangement could be reversed however, and still maintain the same principle, that is the plunger tip could be either flexibly mounted or rigidly mounted on the boot sole plate and the socket could be either rigidly or flexibly mounted on the ski binding. Operationally, the device would be the same but the orientation of the socket would be reversed, that is the variable releasing depression would be milled at the top of the socket to enable vertical release rather than the bottom as shown.

Similarly, although a hemispherical socket or depression is depicted, other surfaces could easily be made suitable as for instance, a conical depression, so long as it would provide a mating surface for the plunger tip, or a suitable contoured groove along the entire toe of the sole plate as discussed below.

Figure 4:
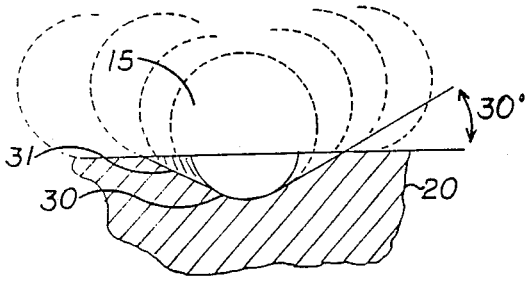
FIG. 4 is a cross-section of the socket along 4—4 of FIG. 3 in illustrating a thirty degree release angle.

FIG. 4 illustrates the movement of the ball-bearing plunger tip 15 when it is subject to a releasing force in either direction along 4—4 of FIG. 3. The ball shown in solid lines when seated at the bottom of hemispherical socket 30 and when subjected to a force vector component along line 4—4 would move into the milled cavity 31 out of the socket and laterally up the incline of the releasing depression 31. The force require to move it along upward of the incline would be proportional to the angle of inclination of the milled depression 31 shown here to be 30 degrees relative to the facing plane containing the socket. Again it can be either the socket that moves or the plunger tip that moves, but the principal and the calculated release force would be the same.

Figure 5:
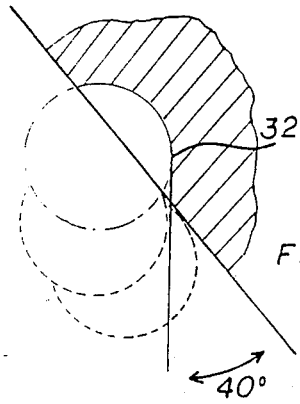
FIG. 5 is a cross-section of the socket along 5—5 of FIG. 3 showing a forty degree release angle.

In similar fashion FIG. 5 illustrates that a force along line 5—5 of FIG. 3 would move the ball-bearing relative to the socket in the direction of milled depression 32 which is at a height angle shown here as 40 degrees and therefore the release force must be higher in that direction.

Figure 6:
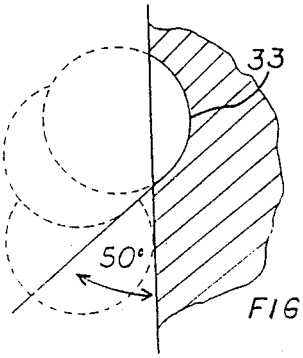
FIG. 6 is a cross-section along line 6—6 of FIG. 3 showing a fifty degree release angle.

FIG. 6 illustrates the same thing as the release force is vertical and moves the ball through depression 33 inclined at 50 degrees. As illustrated the mechanism is calculated to release most easily in a horizontal direction less easily at a 45 degree direction and least easily in the vertical.

Figure 7:
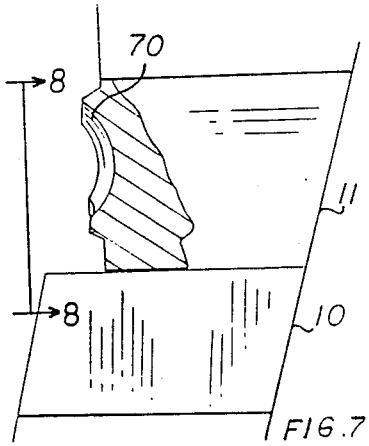
FIG. 7 is a side view of another embodiment of a retaining socket with a cut-away view of the socket in cross-section.

FIG. 7 illustrates an alternative embodiment of the socket configuration which can be shaped to extend from the boot or boot sole plate and provide a more prominent shoulder 70 around the socket to retain the plunger tip or be milled away in a variable configuration to enable release in various directions as previously discussed. With the larger shoulder 70, a wider variation of release forces would be enabled.

Figure 8:
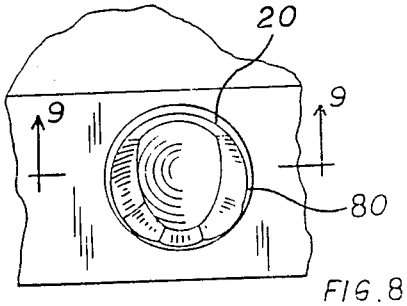
FIG. 8 is a elevation view of the socket of FIG. 7 from viewpoint 8—8 of FIG. 7.

FIG. 8 illustrates that the milling of the perimeter of the socket or ledge. The milling need not be discrete and separated directions as illustrated but can be smoothly blended to finally tune the release forces over the entire 180 degree range from left horizontal through vertical to right horizontal. As the extended perimeter 80 is milled away dramatically as shown along line 9—9 of FIG. 8 it will release quite easily in that direction as illustrated in FIG. 9 even though strongly retained in other directions.

Figure 9:
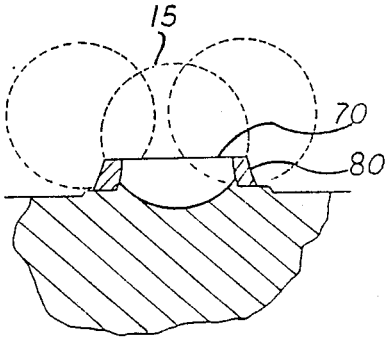
FIG. 9 is a cross-section of the socket of FIG. 7 along line 9—9 of FIG. 8.

FIG. 9 shows a cross sectional view and rolling actions of ball 15 rolling out of the socket and ledge onto shoulder 70 and perimeter 80. This extending rolling action provides shock absorption capability and can vary the force created by depressing the ball 15 against the bias element (not shown for clarity) during this rolling action.

Figure 10:
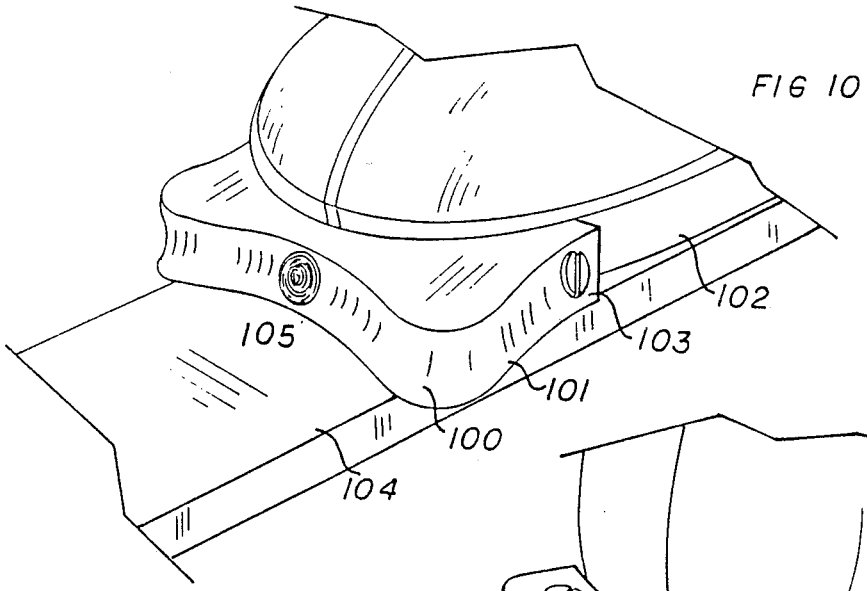
FIG. 10 is a partial perspective view of a typical ski boot toe portion with a contoured receiving groove plate attached to the sole of the boot.

FIG. 10 illustrates an alternative embodiment of the female retaining element of the binding mechanism replacing the contoured socket with a more extensive multiple arc contoured surface consisting of a grooved surface 100 machined in a toe piece 101. Although this piece might be formed as an integral part of the sole, it is here shown as a demountable element attached to the normal boot sole 102 in the toe by mounting screw 103. It can easily be seen that the plunger assembly discussed in the previous figure would mate with the groove surface 100 when mounted longitudinally on the upper ski surface 104 and would not only release in selected directions that would be milled away according to desired release forces and angles but would also absorb lateral shock forces up to a predetermined limit and recenter the device if the shock forces were not of sufficient amplitude or duration to cause lateral release. The recentering could also be made more positive by a centering hemispherical or third spherical arc depression 105. Thus it can be seen that the system can be made flexibly responsive not only to very specific customized release profiles, but further provides a more stable system that can absorb and damp out transient shock forces.

Figure 11:
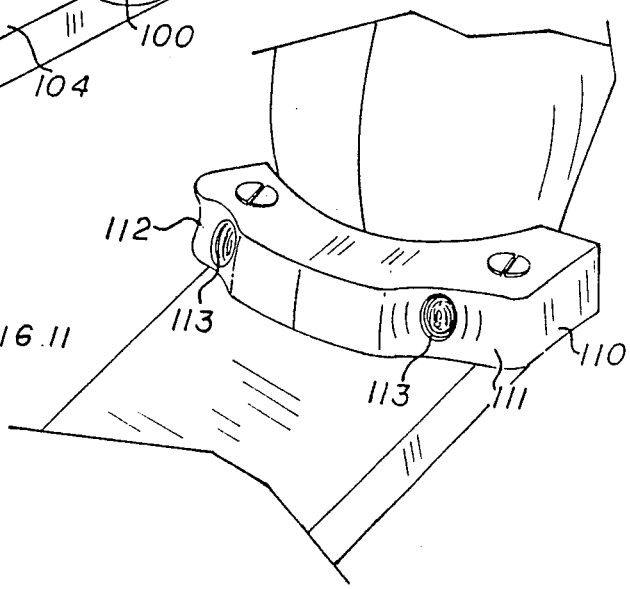
FIG. 11 is a partial perspective view of a typical ski boot heel with a contoured groove plate for receiving two retaining pins mounted to the sole of the boot.

Similarly FIG. 11 illustrates a demountable heel piece 110 including a right contoured retaining groove 111 and a left contoured retaining groove 112 mounted on typical ski boot heel portion of the sole plate. The heel retaining groove will selectively release the mating plunger tips or pins and provide shock absorbing motion in the same manner as discussed in the precious figure, and both left and right grooves may contain centering depressions 113.

Figure 12:
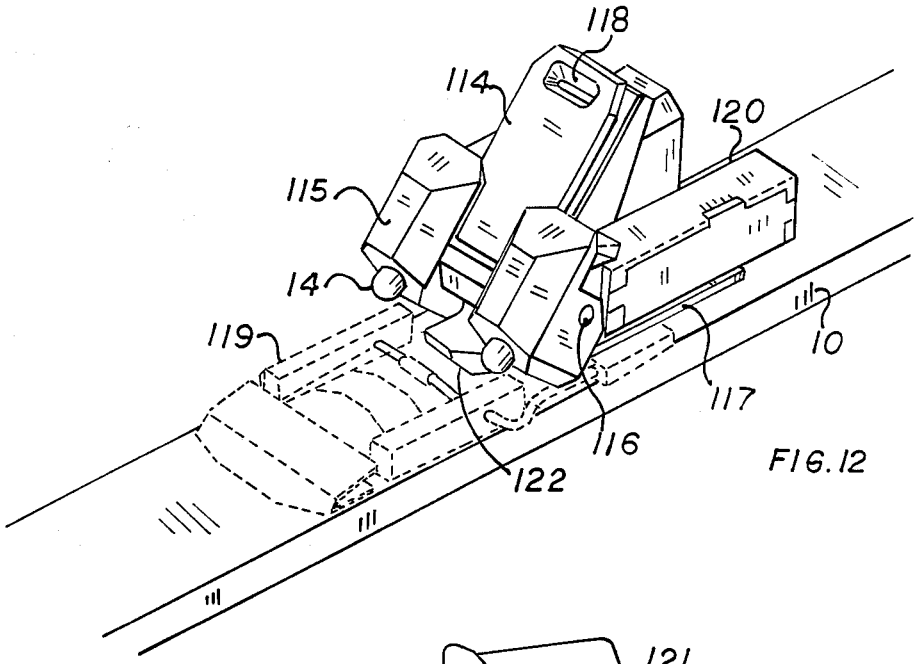
FIG. 12 is a perspective view of an alternate embodiment.

FIG. 12 is a perspective view which illustrates an alternate embodiment of the invention. Two plunger mechanisms 14, similar to that shown in FIG. 2, are mounted on a rocker arm 114 and enclosed in housings 115. The function of plunger housings 115 are again similar to housing 13 shown on FIG. 2, that is to protect the plunger mechanisms from dirt and water/ice intrusions. Rocker arm 114, with attached plungers 14 and housings 115, rotates around pivot pin 116, which is mounted on support structure 117 which is attached to ski 10. On an extension of rocker arm 114 away from the heel of the boot (not shown for clarity in this figure), a hand hold cutout 118 is placed to conveniently rotate rocker arm 114 around pivot pin 116. This configuration allows additional plunger forces to act downward to resist the upward acting forces of a conventional ski brake 119 (shown dotted for clarity). In the configuration shown, plungers 14 are depressed towards hand hold 118 by heel of ski boot (not shown for clarity), providing forces down against the ski brake (holding it in the non-braking position shown) and towards the plunger located at the toe portion of the ski boot (not shown for clarity in this figure). Extensions 120 contain spring mechanisms (not shown for clarity) for latching of rocker arm 114 in either the open or closed position. Support structure 117 are placed on either side of rocker arm 114 to support the spring mechanisms with the extensions 120 and protect the rocker arm from accidental contact with objects during skiing which might tend to open (rotate rocker arm) the ski binding. Hook 122 is depressed by ski boot 121 (see FIG. 13).

Figure 13:
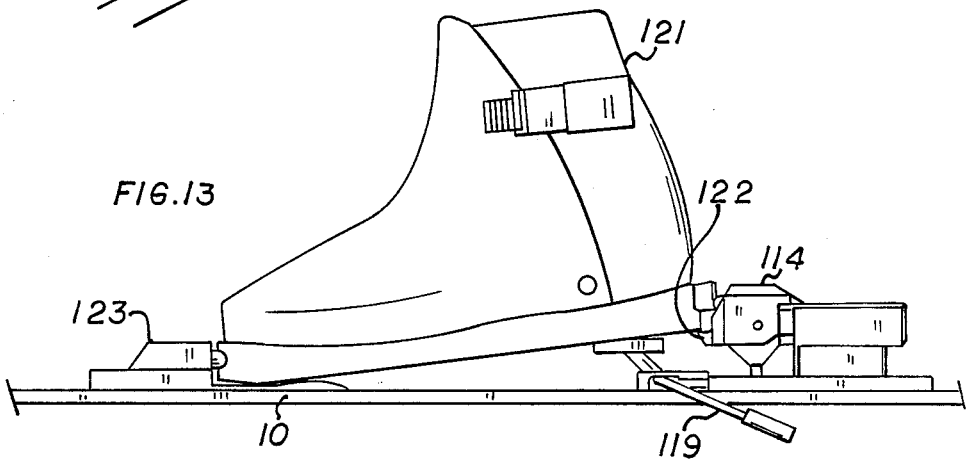
FIG. 13 is a side view of an alternate embodiment.

FIG. 13 is a side view of the alternate configuration shown in FIG. 12, as ski boot 121 enters the binding. Conventional ski brake 119 is in its braking or open position when not depressed by ski boot 121. Rocker arm 114 is in the horizontal or open position, ready to accept ski boot 121. Hook 122 of rocker arm 114 is depressed by ski boot 121 as it simultaneously depresses and retracts ski brake 119 until ski boot 121 is proximate to ski 10. Again, extensions and the support structure 117 protect handle 118 (not shown is this view) from stray objects or accidental actuation as well as housing the latching release mechanism holding the handle in one of two positions. Forward motion of ski boot 121 is restrained by spring element of plunger located in plunger housing 123 proximate the toe of ski boot 121. Housing 123 is also attached to ski 10.

Figure 14:
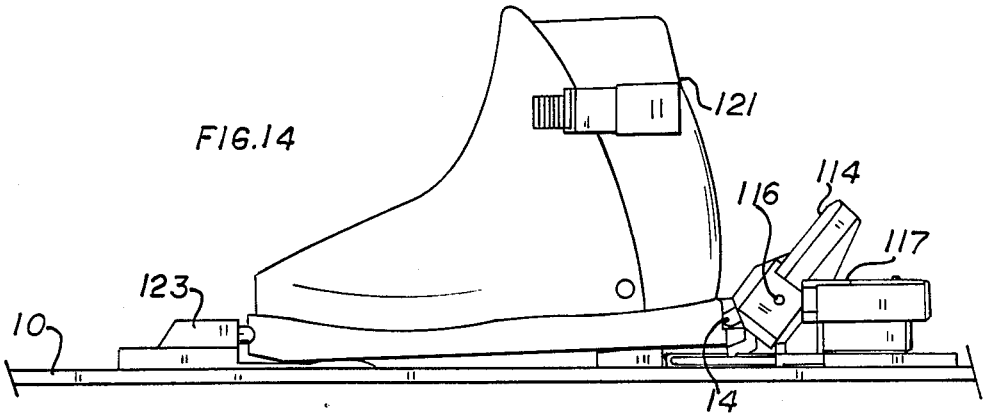
FIG. 14 is a side view of an alternate embodiment in a closed position.

FIG. 14 shows a side view of alternate embodiment in the closed position. Rocker arm 114 forces plunger 14 tips against a contoured surface formed in the heel segment of ski boot 121, forcing heel segment down and the toe segment of ski boot 121 against toe plunger in housing 123. Support structure 117 again partially protects rocker arm 114 from accidental opening, but allows an easy stepping or handle down motion to quickly open the bindings when desired. The shape of the support structure can be varied to increase or decrease the degree of protection from accidental opening.

FIG. 14 also illustrates the combined effect of plungers at the toe and on the rocker arm 114 which gives several degrees of freedom and ability to selectively release the binding upon specific loads and directions. If ski 10 strikes an object causing rapid deceleration, plunger in housing 123 is depressed opening a large gap between the heel of ski boot 121 and the tip of plunger 14, allowing unobstructed release. Unsafe forces in other directions can be similarly provided for immediate release, but short term or lower forces will only slightly displace the ski boot, but not release the boot until the specified unsafe force direction and strength is achieved. In this embodiment, the rocker arm gives an increasing retention force as the heel is raised until the plunger contact points and pivot pin 116 are in line, thereafter fully releasing the ski boot 121. Contoured surfaces on the toe and heel portions similar to those previously discussed can provide similar release force profiles for forces and motions in other directions.

A specific embodiment of the rocker arm configuration shown in FIG. 14 was tested with the following results:

| | STATIC BINDING RELEASE FORCE TEST, FOOT POUNDS | | | | | |
|---|---|---|---|---|---|---|
| | FORCE DIRECTION | | | | | |
| BINDING | AXIAL | | LATERAL | | FORWARD 30 DEGREE | |
| SETTING | FORWARD | BACKWARD | RIGHT | LEFT | RIGHT | LEFT |
| open | 19 | 47 | 27 | 23 | 31 | 34 |
| midrange | 36 | >75 | 32 | 33 | 41 | 41 |

-continued

| BINDING SETTING | STATIC BINDING RELEASE FORCE TEST, FOOT POUNDS | | | | | |
|---|---|---|---|---|---|---|
| | FORCE DIRECTION | | | | | |
| | AXIAL | | LATERAL | | FORWARD 30 DEGREE | |
| | FORWARD | BACKWARD | RIGHT | LEFT | RIGHT | LEFT |
| closed | 49 | >75 | >65 | >65 | 60 | 60 |

These results clearly indicate the selectively directional nature of the invention's ability to retain/release the ski boot 121. Although other prior art also exhibits directional release force behavior, this is accomplished in the present invention by the shape of the grooves and ledges to obtain the ability to select the nature of the directional pattern, distinguishing the invention from prior art.

While the preferred embodiment of the invention has been shown and described, changes and modifications may be made therein within the scope of the appended claims without departing from the spirit and scope of this invention.

What is claimed is:

1. In combination with a snow ski having a major axis parallel to the direction of travel along a snow covered surface by a skier, a snow ski binding assembly, and mating ski boot having heel and toe portions, a multi-directionally selective release mechanism which comprises:

a first plunger housing;

first means for attaching said first housing to said ski proximate to said heel, said first means capable of retaining said first housing in at least two positions relative to said ski;

a first plunger havinq pressure-resilient bias, said first plunger attached to and partially enclosed by said first plunger housing;

a second plunger housing attached to said ski proximate said toe portion;

a second plunger attached to said second housing and having pressure-resilient bias proximate to said toe portion and said second plunger partially enclosed by said second housing;

a generally hemispherical, exposed tip attached to one end of each plunger; and means for detachably contacting said tip to said ski boot wherein said means comprises:

a first contoured surface on said heel portion proximate to and contactable with said first plunger's tip, and a second contoured surface on said toe portion of said ski boot proximate to and contactable with said second plunger tip, said contoured surfaces shaped and dimensioned to selectively release said ski boot from said plunger tips upon application of any of at least three different specific forces in any of at least three different specific directions for specific lengths of plunger travel before release.

2. The combination of claim 1 wherein said first and second contoured structures are integral with said heel and toe of said boot, and said plungers are part of said binding assembly.

3. The combination of claim 1, wherein said contoured surfaces are contained on a sole plate attached to said boot.

4. The combination of claim 1, wherein said contoured structures comprise a sole extension containing at least one of said cavities and means for demountably attaching said sole extension to said boot.

5. The combination of claim 1, wherein said second contoured surface consists of a groove cut in a surface area of said toe, said groove being generally parallel to said plane of said snow covered surface, said groove extending in an arc.

6. The combination of claim 5, wherein each of said contoured surfaces has a concavity profile which is a composite of at least three intersecting sets of arcs with changing radii, said profile shaped and dimensioned to provide specific release force characteristics in different directions.

7. The combination of claim 6, wherein said three intersecting sets of arcs comprise:

a first horizontal arc relative to said ski having a fixed center point on said axis of said plunger;

a second vertical arc relative to said ski, having a traversing centerpoint on a line parallel to said first arc, said second arc having a radius shorter than said first arc; and a third arc having a radius smaller than said horizontal and vertical arcs and having a fixed centerpoint located proximate the intersection of said vertical arc with the axis of said plunger.

8. In combination with a snow ski having a major axis for traveling along a snow covered surface, a snow ski binding assembly and mating ski boot having heel, a toe and a sole, a multi-directionally selective release mechanism which comprises:

an arm;

means for movably mounting said arm on said ski proximate to said heel, said means capable of motion with respect to said ski around an axis parallel to said snow covered surface and perpendicular to said major axis;

a first plunger having pressure-resilient bias, said first plunger attached to said arm in an engageable position with said heel;

a second plunger having a pressure-resilient bias, said second plunger attached to said ski in a direction having said pressure-resilient bias acting generally parallel to said major axis proximate to said toe;

a generally hemispherical, exposed tip attached to one end of said plungers;

a first contoured structure attached to said ski boot heel having a first cavity;

means for engaging said first contoured structure to said first plunger tip and proximate to said heel;

a second contoured structure attached to said ski boot having a second cavity;

means for engaging said second contoured structure to said second plunger tip and proximate to said toe;

said first cavity shaped having a first continuum of varying radii arc cavity segments wherein said cavity segments comprises:

a first cavity segment shaped and dimensioned to depress said first plunger against said bias up to a first incremental distance when said heel is generally rotated a first incremental angle in a plane which is generally perpendicular to said snow covered surface;

a second cavity segment shaped and dimensioned to depress said first plunger against said bias a second incremental distance when said heel is rotated a second incremental angle in a plane which is generally parallel to the plane of said snow covered surface;

a third cavity segment shaped and dimensioned to depress said first plunger against said bias a third incremental distance not equal to either of said first or second distances, when said heel is rotated a third incremental angle in a direction which is out of the planes of either of said first or second incremental angles, said direction being described by the vector sum of components in said first and second directions;

a second cavity shaped having a second continuum of varying radii arc cavity segments wherein said cavity segments comprise:

a fourth cavity segment shaped and dimensioned to depress said second plunger against said bias up to a fourth incremental distance when said sole is generally rotated a fourth incremental angle in a plane which is generally perpendicular to said snow covered surface;

a fifth cavity segment shaped and dimensioned to depress said second plunger against said bias a fifth incremental distance when said sole is rotated a fifth incremental angle in a plane which is generally parallel to the plane of said snow covered surface; and a sixth cavity segment shaped and dimensioned to depress said second plunger against said bias a sixth incremental distance not equal to either of said fourth or fifth distances, when said sole is rotated a sixth incremental angle in a direction which is out of the planes of either of said fourth or fifth incremental angles, said direction being described by the vector sum of components in said fourth and fifth directions.

9. The combination of claim 8, wherein said third cavity segment is shaped and dimensioned to depress said plunger against said bias a third incremental distance which is equal to the vector sum of said first and second incremental distances.

10. The combination of claim 9, wherein said sixth cavity segment is shaped and dimensioned to depress said plunger against said bias a sixth incremental distance which is equal to the vector sum of said fourth and fifth incremental distances.

11. The combination of claim 8 wherein said second cavity segment is shaped and dimensioned to depress said first plunger against said bias said second incremental distance not equal to said first incremental distance when said heel is rotated said second incremental angle after being rotated said first incremental angle.

12. The combination of claim 8, wherein said first and second cavities are substantially hemispherical sockets and the wherein segments of said cavities intersect the remaining surface of said first and second contoured structures to form a smooth surface of changing radius and a rim around the hemispherical sockets.

13. In combination with a snow ski and ski boot having a sole, a toe and heel, a binding assembly comprising: a contoured boot, a plurality of spring loaded plunger assemblies, means for movably mounting at least one of said plunger assemblies on said ski, said means for movably mounting allowing detachable contact with said heel, and at least one of the remaining plunger assemblies longitudinally mounted on the ski, in an opposing plunger arrangement at the toe and heel ends of the boot, each plunger assembly containing a protruding plunger, means for resiliently moving said protruding plunger into said assembly and said plunger having a tip dimensioned to releasably engage a corresponding shaped cavity in each end of the boot, each said shaped cavity having sides selectively shaped in varying arcs at varying angular positions around said sides, said arcs being shaped and dimensioned to establish a variety of release forces applied to the ski boot in relation to the ski at multiple angles around the axis of said plunger.

14. The combination of claim 13, wherein at least one of said shaped cavities forms a horizontal groove having a continuum of arcs each having a different radius to achieve various release forces in different directions.

* * * * *